US005443763A

United States Patent [19]

Notar et al.

[11] Patent Number: 5,443,763

[45] Date of Patent: Aug. 22, 1995

[54] APPARATUS FOR MIXING WATER WITH $CO_2$ GAS TO PRODUCE CARBONATED WATER

[75] Inventors: Robert Notar, Knittlingen; Udo Schwander, Karlsruhe, both of Germany

[73] Assignees: The Coca-Cola Company, Atlanta, Ga.; Bosch-Siemens Hausgerate GmbH, Munich, Germany

[21] Appl. No.: 233,971

[22] Filed: Apr. 28, 1994

Related U.S. Application Data

[63] Continuation of PCT/EP93/02282, Aug. 25, 1993.

[30] Foreign Application Priority Data

Aug. 28, 1992 [DE] Germany ..... 42 28 771.5

[51] Int. Cl.[6] ..... B01F 3/04

[52] U.S. Cl. ..... 261/140.1; 261/26; 261/93; 261/DIG. 7

[58] Field of Search ..... 261/140.1, 93, DIG. 7, 261/26

[56] References Cited

U.S. PATENT DOCUMENTS

| | | | |
|---|---|---|---|
| 2,586,499 | 2/1952 | Anderson | 261/140.1 |
| 2,591,440 | 4/1952 | Kollsman | 261/93 |
| 3,225,965 | 12/1965 | Jacobs et al. | 261/DIG. 7 |
| 3,412,741 | 11/1968 | Mills | 261/26 |
| 4,123,176 | 10/1978 | Barker | 366/166 |
| 4,530,803 | 7/1985 | Kuckens | 261/DIG. 7 |
| 5,190,189 | 3/1993 | Zimmer et al. | 261/DIG. 7 |

FOREIGN PATENT DOCUMENTS 471343 2/1992 European Pat. Off. .

OTHER PUBLICATIONS

International Search Report and U.S. counterpart Patent No. 5,184,942 to EPO reference 471,343.

*Primary Examiner*—Tim R. Miles

[57] ABSTRACT

Apparatus including a circulating pump inside a carbonator tank which blends $CO_2$ with still water and which is started and stopped for predetermined time periods in repetitive cycles having an on/off ratio ranging between 1:10 and 1:20. A timing circuit controls the operating and non operating times of the circulating pump so that sufficient carbonation of the water with $CO_2$ gas is achieved along with the formation of an ice bank on the cooled wall of the storage tank. During intervening periods when the circulating pump is not operating, the carbonated water arranges itself in layers according to its density so that the relatively warmer water sinks while the colder water together with any ice particles or small pieces of ice floating therein join together, becoming fixed to the ice bank in the upper portion of the carbonator. During the next operating cycle of the circulating pump, these particles are frozen together and become relatively harmless to the extent that the shutoff valve and output carbonated water line remains unobstructed. Whenever carbonated water is removed from the storage tank or fresh water is supplied to the storage tank, the circulating pump is again started for an additional on-period time interval which is greater than the normal on-period.

10 Claims, 1 Drawing Sheet

APPARATUS FOR MIXING WATER WITH $CO_2$ GAS TO PRODUCE CARBONATED WATER

This is a continuation of International Application PCT/EP93/02282, with an international filing date of Aug. 25, 1993.

BACKGROUND OF THE INVENTION

This invention relates to apparatus for mixing water with $CO_2$ gas to produce carbonated water in a storage tank and operates to cool its contents and to form an ice bank on the cooling pipes of a cooling circuit in the wall area of the storage tank, whose interior also includes the placement of a circulating pump, whereby $CO_2$ gas from the head area of the storage tank is mixed by rotation and/or circulation with the water inside the storage tank. Both fresh water and $CO_2$ gas are fed into the head area of the storage tank while carbonated water is removed from the base or bottom of the tank.

Apparatus which mixes water with $CO_2$ gas to produce carbonated water is well known and is used, for example, in post-mix beverage dispensing machines so that carbonated beverages can be prepared and dispensed on demand by mixing carbonated water with a suitable drink concentrate. The carbonated water mixed with the drink concentrate is produced directly in the storage tank by mixing water $CO_2$ gas which is fed thereto and thereafter cooled for better carbonation, this being a requirement for a cool refreshing drink which is prepared for consumption as the need arises. The storage tank, commonly referred to as a carbonator, is fed fresh water of drinking quality either from the line of a water supply system or a pressurized storage tank. The fresh water, moreover, can be fed from the water supply system under pressure and can be enhanced, when desired, by the use of a pressure pump. Further, $CO_2$ gas is fed to the carbonator from a $CO_2$ gas storage tank by a pressure-reducing regulating valve so that a pressure of, for example, about 4 bars is built up in the carbonator.

In order to ensure sufficient carbonation of the fresh water, the carbonation process can be accomplished by or assisted by the use of a $CO_2$ circulating pump located in the carbonator. This type of pump draws $CO_2$ gas from the upper or head-space region of the carbonator filled with $CO_2$ gas and blends it with circulating water which is set in circular motion, such as by spinning.

As already noted, cooling of the carbonator is used, not only to improve the carbonation, but also as a requirement so that the finally prepared and dispensed drink exhibits a desired low and basically constant temperature. The cooling of the carbonator is achieved by a cooling system, which is adapted to form an ice bank of generally uniform thickness along the inner side walls of the carbonator as a result of the circulating water. Consequently, a cooling capacitor is produced, thus enhancing its "refrigerating capacity", thereby removing the need for a relatively powerful cooling system which would be necessary in a once-through cooling system.

Arrangements having a corresponding design as described above are well known, a typical example being shown and described in U.S. Pat. No. 5,184,942, Deininger et al, Feb. 9, 1993.

In the dispensing of a freshly prepared carbonated drink, a shutoff valve is typically opened in a line connected to the bottom of the carbonator, whereupon cooled carbonated water is fed therefrom to a concentrate mixing station. As a result of forming the ice bank in the area of the cooling coils, the carbonated water is cooled to near the freezing point. As such, an inherent danger exists due to the fact that the ice particles or pieces of ice floating in the carbonated water can get into the area of the outlet which can become clogged. Ice formation in this area is substantially impossible due to the fact that relatively warmer water tends to sink because of the special behavior of water relative to its specific density near the freezing point, and because the discharge opening is normally placed in the immediate vicinity of the circulating pump which also radiates a certain amount of heat. However, the circulating movement of the water, which is necessary or at least helpful for carbonation and for uniform formation of the ice bank on the walls of the carbonator, causes detached floating or otherwise suspended ice in the upper areas, particularly those with open dispensing channels, to accumulate in and clog the outlet region.

SUMMARY OF THE INVENTION

The object of this invention, therefore, is to provide a means which guarantees highly reliable, trouble-free operation of a carbonator for a post-mix dispenser.

Apparatus which meets this requirement includes a circulating pump inside a carbonator tank which blends $CO_2$ with still water and is started and stopped for predetermined time periods in repetitive cycles while being controlled by a timing circuit.

Apparatus which accomplishes the desired objectives of this invention controls the operating and nonoperating times of the circulating pump so that sufficient carbonation of the water with $CO_2$ gas is achieved along with the formation of an ice bank on the cooled wall of the storage tank. During intervening periods when the circulating pump is stopped, the carbonated water arranges itself in layers according to its density so that the relatively warmer water sinks while the colder water together with any ice particles or small pieces of ice floating therein join together, becoming fixed to the ice bank in the upper portion of the carbonator. During the next operating cycle of the circulating pump, these particles are frozen together and become relatively harmless to the extent that the shutoff valve and output carbonated water line remains unobstructed. The on and off control of the circulating pump is accomplished by a timing circuit which produces a relatively simple mode of operation.

According to a preferred embodiment of the invention, the circulating pump is controlled so that an on-period of about 1 to 2 minutes is produced and a ratio of on-period to off-period of about 1:10 to 1:20 is provided. It turns out that an on-period of 1 to 2 minutes within an on/off cycle ratio of 1:10 to 1:20 achieves sufficient carbonation of the still water while maintaining a uniform ice bank of a desired thickness.

According to another embodiment of the invention, when carbonated water is removed from the storage tank or fresh water is supplied to the storage tank, the circulating pump is again started for an additional on-period time interval. In this instance, a supplemental on-period of about 2 to 4 minutes has been determined to be suitable. Following this additional on-period, the normal constantly repeating control cycle is again resumed, i.e. the circulating pump is turned on for 1 to 2 minutes while the off-period between the on-phases in each case is made to be 10 to 20 times larger.

BRIEF DESCRIPTION OF THE DRAWINGS

The details of the invention as set forth below will be more readily understood when considered together with the following drawings, wherein.

DETAILED DESCRIPTION OF THE INVENTION

Figure 1:
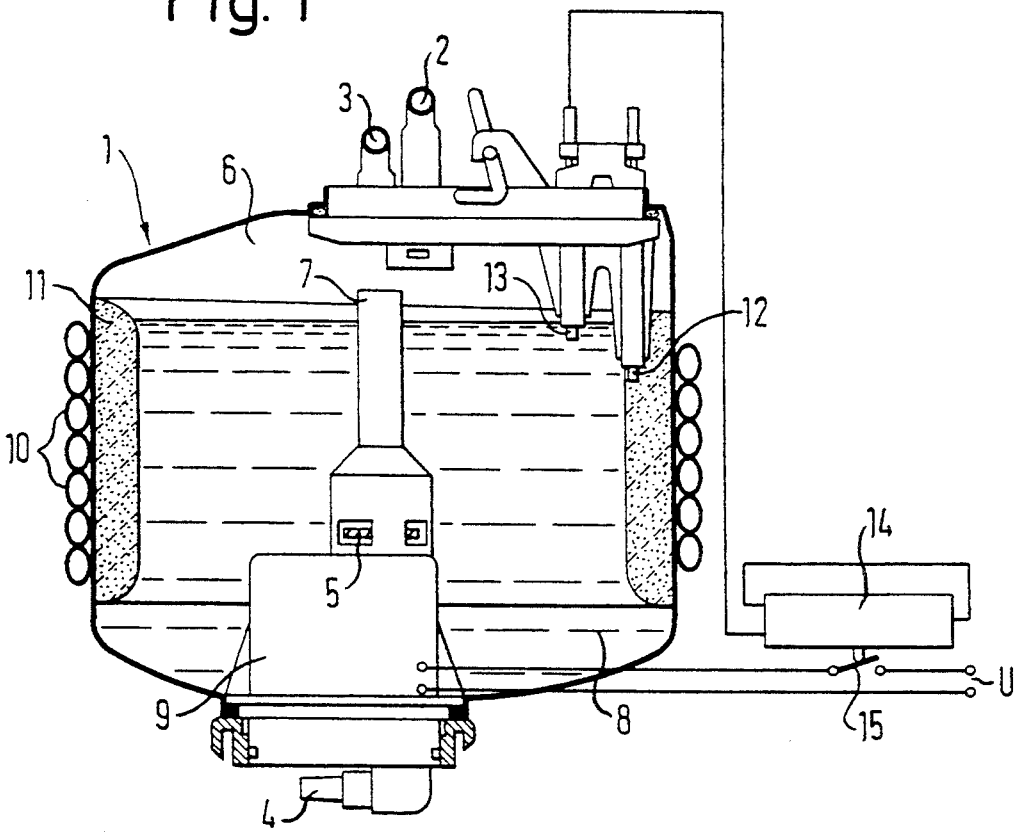
FIG. 1 is a schematic illustration of a cooled storage tank or carbonator having a circulating pump therein for preparing and holding carbonated water.

A storage tank 1, as it is represented in the figures, is particularly adapted for use in devices for preparing post-mix beverages where a suitable amount of concentrate is added to carbonated water or optionally simply to fresh or still water without carbonation.

Fresh water is fed into the tank 1 by a feed pipe 2, and $CO_2$ gas fed thereto by a feed pipe 3. In order to prepare a post-mix beverage, a predetermined amount of cooled sufficiently carbonated water is removed from the tank 1 by an output line 4. Carbonation takes place and is at least assisted by a circulating pump 5, which draws the $CO_2$ gas from head region 6 of the storage tank 1 by a suction pipe 7 and mixes it with stored fresh water 8 at the level of circulating pump 5. As a result, the $CO_2$ gas fed into the pipe 7 is dissolved to its fullest in the fresh water 8. The circulating pump 5 is driven by an electric motor 9.

The cooling of the carbonated supply 8 takes place in the vicinity of a set of externally located evaporator coils 10 of a cooling system, not shown. A shell of ice 11 is formed on the interior wall surface of the storage tank 1 in the area adjacent the evaporator coils 10. The thickness of this ice bank 11 is monitored by an ice sensor 12 which controls the refrigeration cycle and thus the refrigerating capacity of the system.

The effect of the shape of the ice bank 11 is that the water 8 can be cooled to a very constant temperature in the immediate range of its freezing point without very sensitive detections, when a water change occurs, i.e., when carbonated water is removed from the carbonator tank 1 via by output line 4 or is replenished by warmer water, controlled by a water level sensor 13, fed by feed pipe 3. In this case, the ice pack partially breaks down relatively quickly in certain areas, however, it is again built up by the cooling effect of the evaporator coils 10.

The fact that not only does the stored water 8 but also the ice bank 11 in the boundary area of the water attain a freezing temperature, ice particles or small floating or suspended pieces of ice are formed in the water 8 which are also circulated by the activity of the circulating pump 5 during carbonation of the water 8. When the output line 4 is opened, some of this ice can get into the discharge opening of the output line due to the pressure of the $CO_2$ gas in head area 6 on the water 8. As a result, the dispensing process of the water by output line 4 can adversely be affected and even blocked. The preparation of a normal beverage is thus prevented.

To prevent this condition from occurring, the subject invention provides a scheme for keeping the outlet ice-free. Previous measures attempting to prevent the icing of the output line 4 was to locate the opening in the immediate vicinity of and/or below a randomly operated circulating pump 5, whereupon the heat generated by the pump drive motor 9 provided some deicing effect. However, this approach has been found to be insufficient when suspended particles of ice are present in the carbonated water For this reason, the electric circulating motor 9, in accordance with this invention, is now controlled so as to be periodically actuated in a predetermined repetitive sequence which will now be explained. An "ON" operating time period of about 1 to 2 minutes is immediately followed by an "OFF" time having a period of 10 times to 20 times the ON time period. During the OFF time period, the heretofore agitated circulated water 8 becomes calm, and ice particles and small pieces of ice parts suspended in the water rise to the surface because of their lower density. There they are combined and/or attach themselves to the outer surface of the ice bank 10. These icy elements are thus neutralized when the following ON period occurs.

To bring the water supply as quickly as possible to the necessary degree of carbonation in the case of water change, i.e., when carbonated water is removed and/or fresh water is added, the electric motor 9 is also actuated each time carbonated water is removed or fresh water is added notwithstanding the cyclic operation described above. Thus the circulating pump 5 is again started for a predetermined supplementary ON time period for each water removal or addition, after which the respective on/off cycle described above starts again.

The circuit for controlling the on/off periods of the circulating pump 5 uses a start signal derived from the water level sensor 13. This signal is initially fed to a counter circuit 14 following initial water feed delivery to the tank and which closes a power switch 15 coupled to the electric motor 9 driving the circulating pump 5, and which begins to operate. When the water level sensor 13 detects a predetermined amount of water during a filling or refilling operation, the water in the feed line 2 is cut off and the power switch 15 opens. At this time the counter circuit 14 also begins to count and generate the desired ON and OFF time period control signals for the pump drive motor 9. Thus for a time ranging between 1 to 2 minutes, depending on the design of the counting chain, the power switch 15 remains closed and the circulating pump 5 is driven. The switch 15 then opens until the counting circuit 14 has reached a preset upper value or count, after which it is reset back to an initial starting value where the cycle starts all over unless interrupted by a water delivery and/or replenishment operation.

Figure 2:
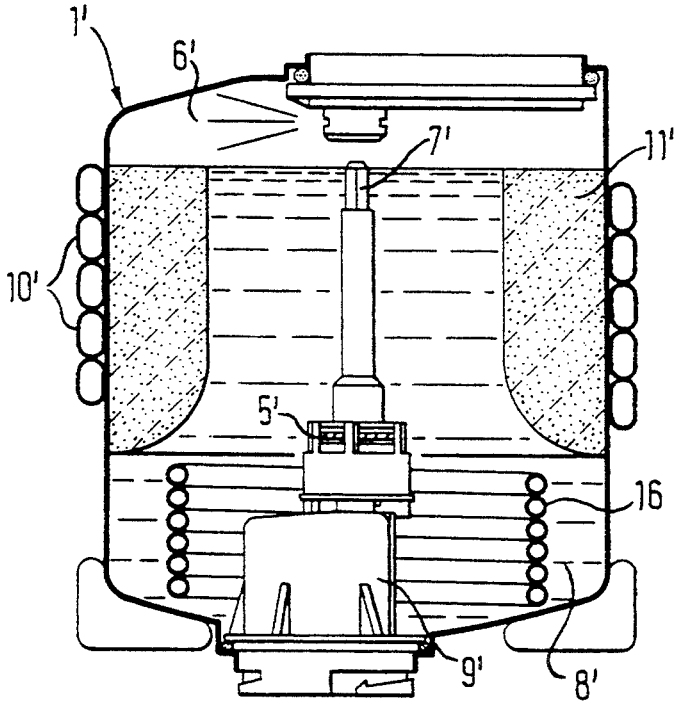
FIG. 2 is a modification of the embodiment shown in FIG. 1, and additionally discloses the location of another set of cooling coils inside the storage tank.

FIG. 2 shows a modification of the storage tank illustrated in FIG. 1. There the outer evaporator coils 10' on storage tank 1' are still located on the upper wall portion of the tank, with the ice bank 11' also being formed thereat on the inside wall surface. Now a set of inner coils 16 are located in the tank 1' around the circulating pump 5' and its drive motor 9'. The coils 16 carry and transport other water which is cooled by the carbonated water 8'. As before, however, during the rest or OFF period of the circulating pump 9', relatively warmer water 8' collects in the lower zones of storage tank 1', because of its greater density, so that the danger of icing of water in the pipe coils 16 is also prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus for mixing fresh water with $CO_2$ gas to produce carbonated water, comprising:

a storage tank which operates to cool its contents;

a cooling circuit including a set of cooling coils for forming an ice bank on an inner wall surface of the storage tank;

a circulating pump located inside the storage tank for mixing $CO_2$ gas from a head region of the storage tank with water in the storage tank and forming carbonated water thereby and/or imparting a circular flow to the carbonated water inside the storage tank;

outlet means for removing carbonated water from a bottom portion of the storage tank; and control means for operating said circulating pump in repetitive cycles of consecutive ON and OFF time periods of respective predetermined lengths for causing relatively warmer water to sink and relatively colder water to rise, thereby causing any ice formed and floating in the water to come together and attach itself to the ice bank while keeping the outlet means free of floating ice.

2. The apparatus according to claim 1 wherein said control means includes counter circuit means for controlling said ON and OFF time periods.

3. The apparatus according to claim 1 wherein the length of the OFF time period is substantially larger than said ON time period.

4. The apparatus according to claim 3 wherein the ratio of the ON time period to the OFF time period ranges between about 1:10 and 1:20.

5. The apparatus according to claim 1 wherein said ON time period ranges from about 1 minute to about 2 minutes.

6. The apparatus according to claim 5 and wherein said OFF time period is at least about 10 times as long as the ON time period.

7. The apparatus according to claim 5 and wherein said OFF time ranges between about 10 and 20 times longer than the ON time period.

8. The apparatus according to claim 1 wherein said control means operates the circulating pump for a supplemental ON time period whenever carbonated water is removed from the storage tank or fresh water is supplied.

9. The apparatus according to claim 8 wherein said supplemental ON time period is greater than said ON time period and less than said OFF time period.

10. The apparatus according to claim 9 wherein said ON time period ranges between about 1 and 2 minutes and said supplemental ON time period ranges between about 2 and 4 minutes.

* * * * *